US006340237B1

(12) United States Patent
Koga et al.

(10) Patent No.: US 6,340,237 B1
(45) Date of Patent: Jan. 22, 2002

(54) LAMP CARTRIDGE

(75) Inventors: Ritsuo Koga; Hideto Kubouchi, both of Tokyo (JP)

(73) Assignee: Plus Corporation, Tokyo (JP)

( * ) Notice: Subject to any disclaimer, the term of this patent is extended or adjusted under 35 U.S.C. 154(b) by 0 days.

(21) Appl. No.: 09/254,651

(22) PCT Filed: Jul. 28, 1998

(86) PCT No.: PCT/JP98/03341

§ 371 Date: Mar. 11, 1999

§ 102(e) Date: Mar. 11, 1999

(87) PCT Pub. No.: WO99/06763

PCT Pub. Date: Feb. 11, 1999

(30) Foreign Application Priority Data

Jul. 31, 1997 (JP) ..... 9/205121

(51) Int. Cl.[7] ..... F21V 29/00
(52) U.S. Cl. ..... 362/294; 362/373; 362/804
(58) Field of Search ..... 362/294, 373, 362/345, 804

(56) References Cited

U.S. PATENT DOCUMENTS 3,461,282 A * 8/1969 Marinez ..... 362/294
3,864,547 A * 2/1975 Ray ..... 362/294
4,572,164 A * 2/1986 Yoshida et al. ..... 128/6
4,630,182 A * 12/1986 Moroi et al. ..... 362/294
5,093,769 A * 3/1992 Luntsford ..... 362/294
5,099,399 A * 3/1992 Miller et al. ..... 362/294
5,473,524 A * 12/1995 Behringer ..... 362/294

FOREIGN PATENT DOCUMENTS

JP 4-482 Y 1/1992
JP 56124 2/1992
JP 137340 12/1992
JP 6-59238 A 3/1994

* cited by examiner

*Primary Examiner*—Sandra O'Shea
*Assistant Examiner*—John Anthony Ward

(57) ABSTRACT

A lamp cartridge according to the present invention includes a lamp as a light source; a reflecting mirror for converging the light emitted from the lamp; and several side surfaces forming a case for covering the lamp, the reflecting mirror and for supporting the reflecting mirror. In the present invention, one of the surfaces forming the case where light is emitted out of the lamp cartridge and away from the reflecting mirror is provided with a hole having a diameter smaller than that of the end of the reflecting mirror. In addition, an optical axis of the hole is directly aligned with an optical axis of the end of the reflecting mirror where light is emitted out of the lamp cartridge. Further, a fan is provided on one of the side surfaces forming the lamp cartridge case. Outside air is introduced through the hole and into the interior of the lamp cartridge whereby heat generated by the lamp and the reflecting mirror is exhausted by the fan.

28 Claims, 8 Drawing Sheets

1 ··· lamp cartridge

2 ··· reflecting mirror

2a ··· neck portion of the reflecting mirror

3 ··· case

4 ··· fan

5 ··· hole

6 ··· slit

7 ··· lamp

7a ··· tip electrode

7b ··· bulb

7c ··· end portion

8 ··· louver

9 ··· clearance

10 ··· window

11 ··· supporting base

FIG.13

LAMP CARTRIDGE

This application is the national phase under 35 U.S.C. §371 of prior PCT International Application No. PCT/JP98/03341 which has an international filing date of Jul. 28, 1998 which designated the United States of America.

TECHNICAL FIELD

The present invention relates to a lamp cartridge utilized as a lighting device incorporated into an image displaying apparatus.

RELATED ART

In order to ensure the safety of a metal halide lamp (arc lamp)or the like used as a high intensity light source for an image displaying apparatus and allow it to demonstrate the specification and performance thereof intended by its manufacturer, it is required to keep the temperatures at the specified portions on the metal halide lamp, a reflecting mirror, and so on at predetermined values.

FIG. 12 shows portions of a lamp 7, a reflecting mirror 2, and a supporting base 11 for the lamp 7 and the reflecting mirror 2 whereof the temperatures should be kept at predetermined values (predetermined values differ from portion to portion).

Reference characters 2*a* represent a neck portion of the reflecting mirror 2, and 7*a,* 7*b,* and 7*c* represent respectively a tip electrode, a bulb, and an end portion of the lamp 7, whereof the temperatures are required to be maintained at predetermined values, as well as the temperatures of the reflecting mirror 2 and the lamp 7.

Miniaturization of the image displaying apparatus requires miniaturization of the reflecting mirror 2, the lamp 7, the lamp supporting portion, the fan and so on which occupy a relatively large volume of the apparatus, and thus results in an inconvenience as described below That is, in order to obtain at least the same intensity of illumination as the conventional apparatus, it is necessary to increase the intensity of the lamp when miniaturizing it. Therefore, the lamp emits superheat, and thus will need a high-power fan and a lamp supporting portion with sufficient heat resistant properties.

In addition, in a conventional exhaust mechanism or a mechanism for blasting cooling air by means of a nozzle, it is difficult to maintain predetermined portions stated above at predetermined temperatures, and thus the specification and performance of the lamp cannot be demonstrated, which will cause shortening of the lifetime, irregularity of the intensity of illumination, and deterioration of the color rendering properties of the lamp.

Furthermore, a conventional exhaust mechanism suffers from insufficient heat exhaust efficiency of the fan, and thus requires increase of the output of the fan which may cause a serious noise problem.

An object of the present invention is to provide a lamp cartridge of which components such as a lamp, a reflecting mirror, a lamp supporting portion, a fan and so on can be effectively miniaturized.

Another object of the present invention is to provide a lamp cartridge enabling the lamp to demonstrate its specification and performance sufficiently.

SUMMARY OF THE INVENTION

The lamp cartridge according to the present invention comprises a lamp being a light source, a reflecting mirror for converging light emitted by the lamp, a case for covering the lamp and the reflecting mirror and for supporting the reflecting mirror, and a fan disposed at a window on the side surface of the case covering the side of the reflecting mirror for exhausting heat from within the case. On one of the surfaces constituting the case from which the ray from the reflecting mirror goes out, a hole including the optical axis of the reflecting mirror and having a diameter smaller than that of the reflecting mirror is provided. In this arrangement, the air outside the case is introduced through the hole into the case so that heat generated by the lamp and the reflecting mirror is exhausted from the case by means of the fan.

The present invention also includes a lamp cartridge having a fan provided at the window made on the surface of the case behind the reflecting mirror.

The present invention further includes a lamp cartridge having a slit on the surface of the case on the opposite side of the fan, or on the surface of the case behind the reflecting mirror in the vicinity of the surface on the opposite side of the fan for introducing the outside air into the case therethrough and exhausting heat generated by the lamp and the reflecting mirror by means of the fan.

The present invention still further includes a lamp cartridge having a fan provided at the window made on the surface of the case behind the reflecting mirror, wherein at least one slit is provided on the side surface or surfaces of the case covering the side or the sides of the reflecting mirror in the vicinity of the surface of the case on the opposite side of the fan, or on the surface of the case on the opposite side of the fan for introducing the outside air into the case therethrough and exhausting heat generated by the lamp and the reflecting mirror by means of the fan.

The present invention still further includes a lamp cartridge having various kinds of structures as mentioned above, wherein the center of the hole from which the ray goes out is displaced relative to the optical axis of the reflecting mirror.

The present invention still further includes a lamp cartridge having various kinds of structures as mentioned above, wherein a louver for shading leakage light from the lamp is disposed between t he case and the fan.

BRIEF DESCRIPTION OF DRAWINGS

FIG. 13 is a description of the reference numerals shown in FIGS. 1–12.

DETAILED DESCRIPTION OF THE PREFERRED EMBODIMENTS

In order to clarify the present invention, there are shown several embodiments with reference to the accompanying drawings.

Figure 1B:
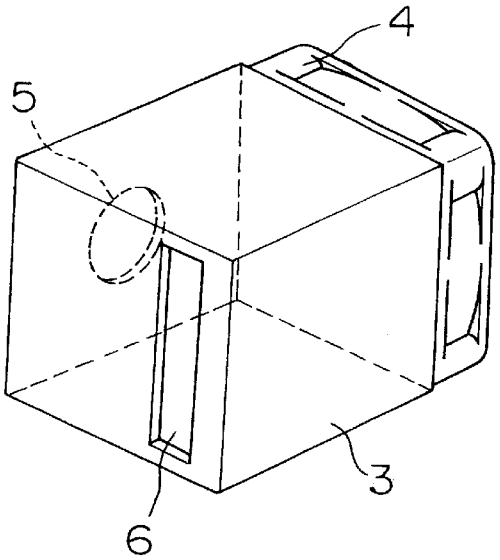
FIG. 1A and FIG. 1B are sketch perspective views of the first embodiment according to the present invention.
Figure 1A:
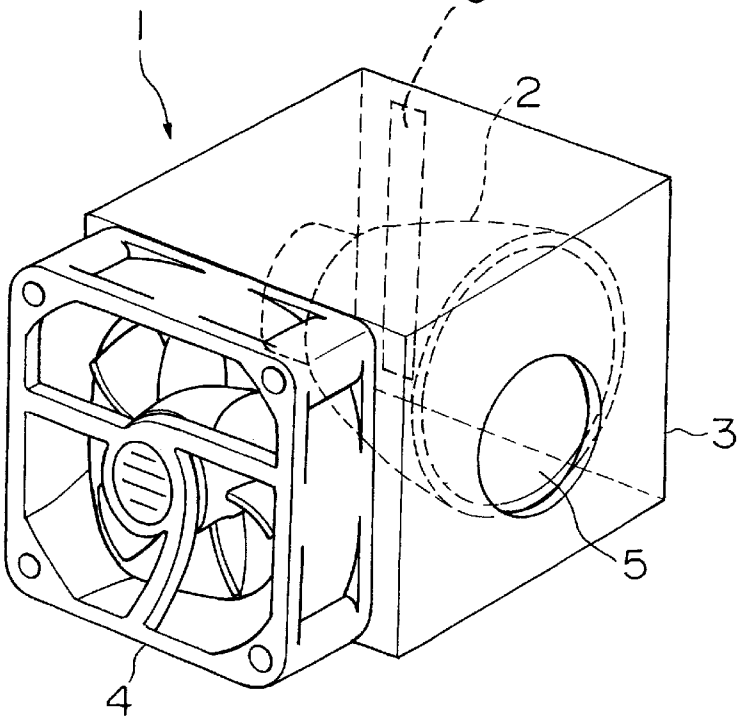

FIG. 1A and FIG. 1B are sketch perspective views of the first embodiment.

A lamp cartridge 1 comprises a lamp, a lamp supporting portion, a reflecting mirror, a reflecting mirror supporting portion, a louver, a case, and a fan. However, a louver, a lamp in the case, a lamp supporting portion, and a reflecting mirror supporting portion are omitted to illustrate in FIG. 1A and FIG. 1B.

In the first embodiment, a fan 4 is disposed at the window on the side surface of the case 3 which covers one side of the reflecting mirror 2, a hole 5 is made on the surface of the case from which illuminating light from the reflecting mirror 2 goes out, and a slit 6 is provided on the surface of the case on the opposite side of the fan 4 so that the outside air is introduced from the hole 5 and the slit 6.

The case 3 is made of resin or metal having heat resistant properties, and a treatment (for example, application of mat black paint) for preventing irregular reflection of leakage light from the lamp is applied on the inner surface thereof.

Figure 2:
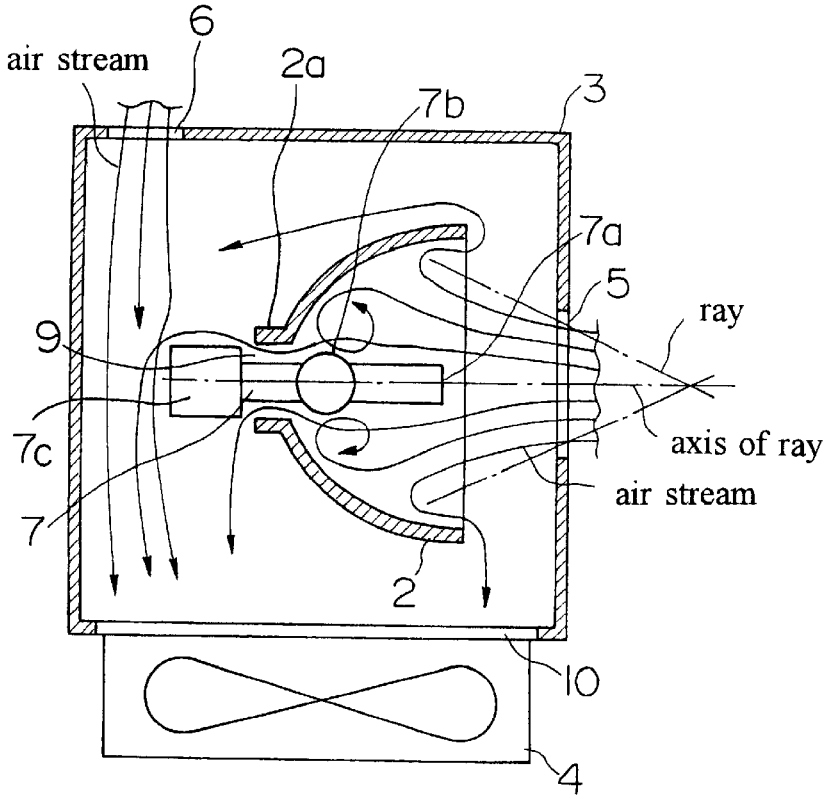
FIG. 2 is a transverse sectional view of the first embodiment.
Figure 3:
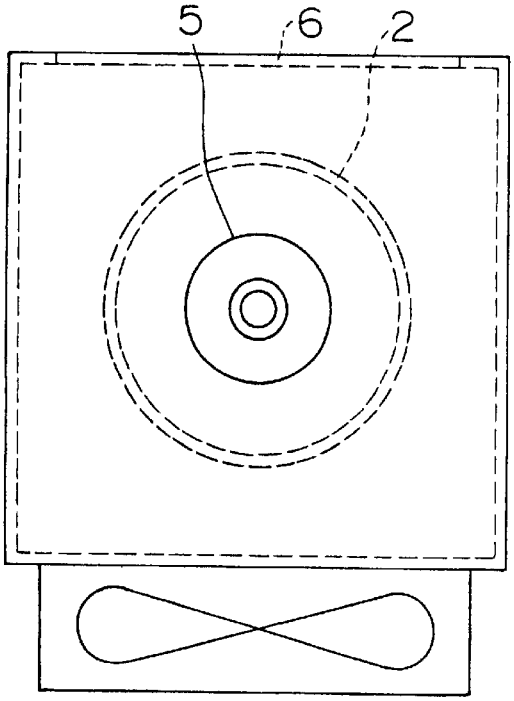
FIG. 3 is a side view of the first embodiment.

FIG. 2 is a transverse sectional view of the first embodiment, and FIG. 3 is a side view of the first embodiment.

In these figures, a louver, a lamp supporting portion, an electrode of the lamp, and a supporting portion of the reflecting mirror are omitted to illustrate.

The ray irradiated from a bulb 7*b* of the lamp 7 is reflected by the reflecting mirror 2 and converged as a secondary light source.

Referring now to FIG. 2, the effect of the first embodiment will be described. Arrows in the figure show the air stream flow when the fan 4 is rotated.

In FIG. 2, the numeral 10 represents a window at which the fan 4 is disposed.

The hole 5 serves to introduce the air from outside the case, and the air stream cools the tip electrode 7*a,* the bulb 7*b,* and the reflecting surface of the reflecting mirror 2 down.

Preferably, especially in the first embodiment, a clearance 9 is provided between the neck portion 2*a* of the reflecting mirror 2 and the lamp 7. The reason is that the neck portion 2*a* of the reflecting mirror 2 and the end portion 7*c* of the lamp 7 may be effectively cooled down by the air stream passing through the clearance 9.

Further, the size of the hole 5 being smaller than the outer diameter of the reflecting mirror 2 is effective for cooling each portion stated above down.

In the first embodiment, the hole 5 is circular having a center thereof corresponding to the axis of ray, however, the configuration of the hole 5 is not limited to a circle. The hole 5 may be oval or rectangular, for example.

Hereinafter, the effect of the slit 6 provided on the surface of the case on the opposite side of the fan 4 will be described.

By providing the slit 6, the flow rate of the air inhaled through the hole 5 may be controlled, as well as the temperature of the tip electrode 7*a,* the bulb 7*b,* and the reflecting mirror 2.

By the air stream coming through the slit 6, the temperature of the reflecting mirror and the end portion 7*c* of the lamp 7 may be controlled.

Further, by introducing the outside air through the slit 6, the temperature within the case 3 may be lowered so that the temperature of the air exhausted by the fan 4 may be lowered.

Therefore, the temperature rating of the fan 4 may be maintained at a low value, and thus the lifetime of the fan 4 may be elongated.

Although the slit 6 is provided on the surface of the case on the opposite side of the fan 4 in the first embodiment described above, it is understood that the present invention is not limited to such an arrangement, and the fan 4 may be provided on the surface of the case behind the reflecting mirror 2 in the vicinity of the surface on the opposite side of the fan 4.

The configuration and the size of the slit 6 are also not limited to the embodiment shown in FIG. 1A, FIG. 1B and FIG. 2, and may be determined experimentally according to the specification of the fan 4, the output of the lamp 7, the size of the reflecting mirror 2, the size of the hole 5, and so on.

Although it is desirable to provide the slit 6, the temperature within the case may be lowered, even without the slit 6, by the effect of the hole 6, and thus the temperature of the air exhausted by the fan 4 may be lowered.

Figure 4:
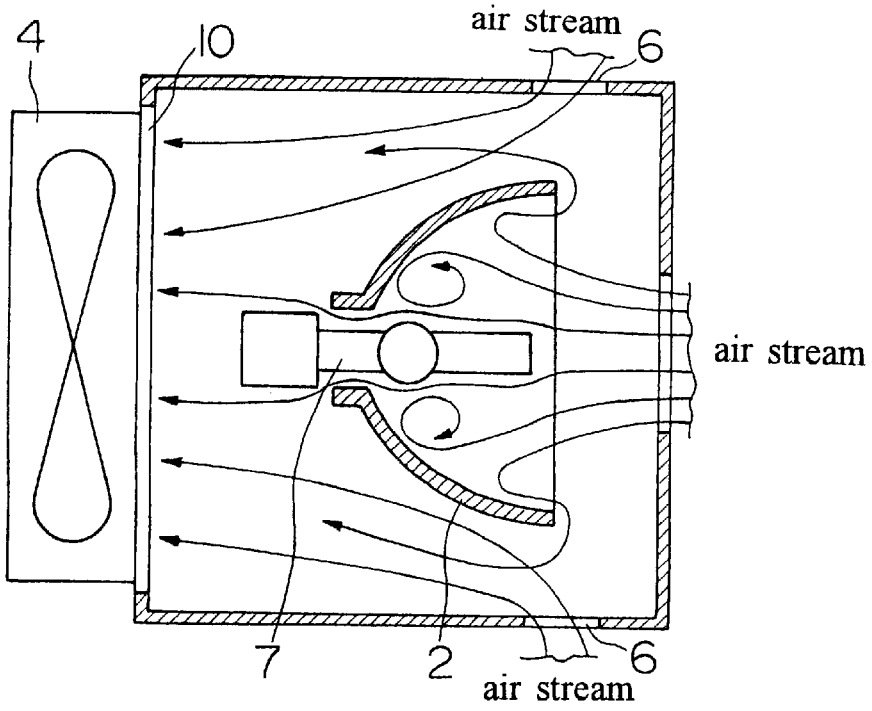
FIG. 4 is a transverse sectional view of the second embodiment.
Figure 5:
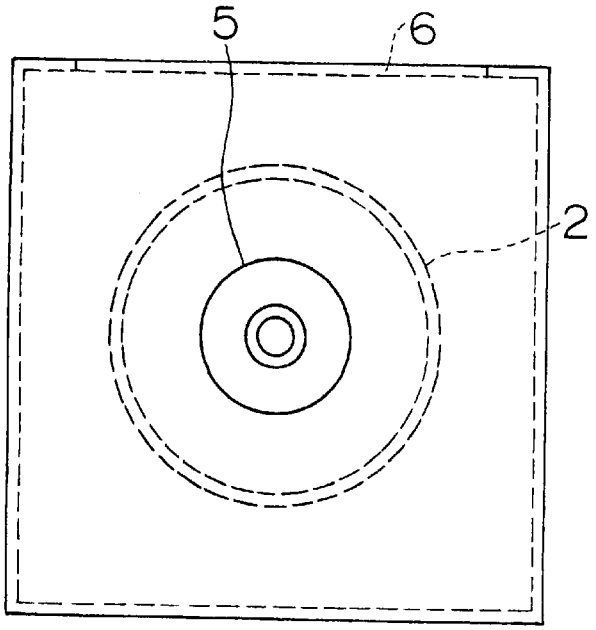
FIG. 5 is a side view of the second embodiment.

FIG. 4 is a transverse sectional view of the second embodiment, and FIG. 5 is a side view of the second embodiment.

Hereinafter, points which differ from the first embodiment will be described.

In the second embodiment, the fan 4 is provided at the window 10 on the surface of the case behind the reflecting mirror 2. The slits 6 are provided on both side surfaces of the case 3 which cover the sides of the reflecting mirror 2 in the vicinity of the surface on the opposite side of the fan 4. The slits 6 may be provided only on one of the side surfaces of the case.

The effect of the slits 6 is generally the same as that of the first embodiment. The slit 6 may be provided on the surface of the case on the opposite side of the fan 4 (that is, the surface provided with the hole 5 thereon).

The size and the number of the slit 6 may be determined experimentally. Although it is preferred to provide the slit 6, the temperature within the case 3 may be lowered, even without the slit 6, by the effect of the hole 5, and thus the temperature of the air exhausted by the fan 4 may be lowered.

Figure 6:
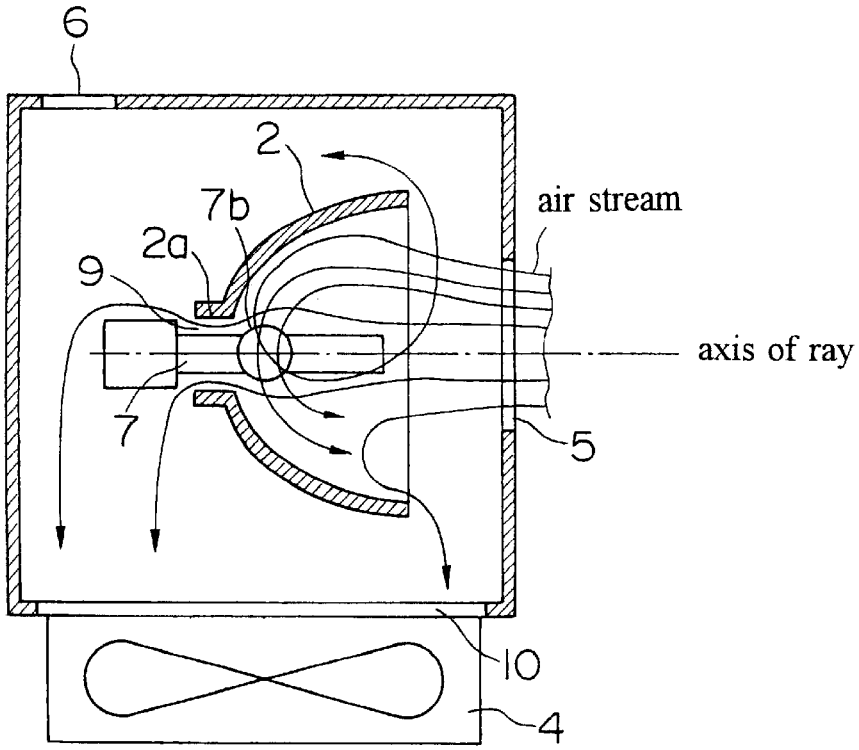
FIG. 6 is a transverse sectional view of the third embodiment.
Figure 7:
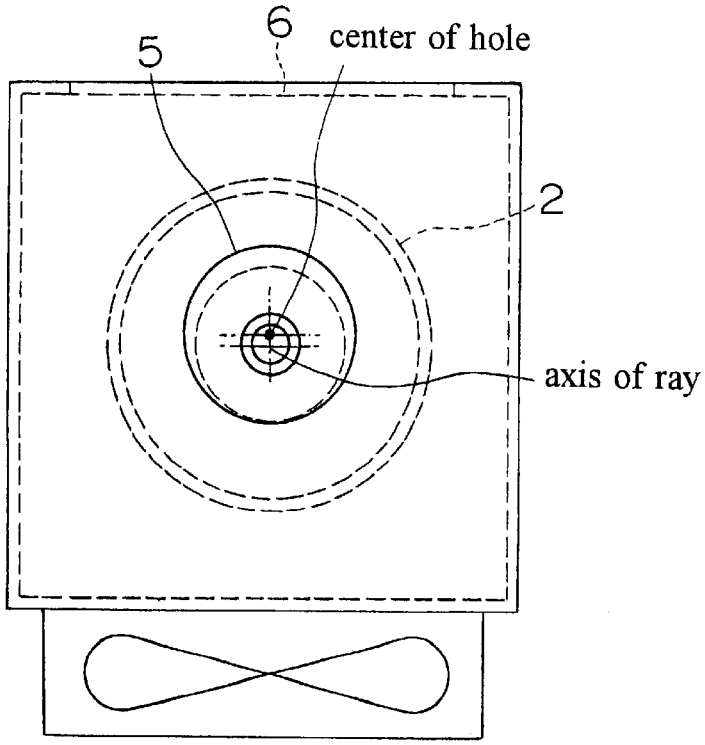
FIG. 7 is a side view of the third embodiment.

FIG. 6 is a transverse sectional view of the third embodiment, and FIG. 7 is a side view of the third embodiment.

In the third embodiment, as clearly shown in FIG. 7, the hole 5 is eccentrically disposed relative to the optical axis of the reflecting mirror 2. The air introduced from the eccentric hole 5 flows biasedly along the reflecting surface of the reflecting mirror 2 (as shown with arrows in FIG. 6), sufficiently cools the bulb 7*a* and the reflecting mirror 2 which are heated, and then flows quickly from the inner surface of the reflecting mirror 2 toward the fan 4 without residing there.

Therefore, the cooling effect is improved by a large margin.

The third embodiment is especially effective in the case where there is no clearance between the neck portion 2*a* of the reflecting mirror 2 and the lamp 7. However, FIG. 6 shows the structure having the clearance 9.

Here as well, the fan 4 and the slit 6 are disposed in the same manner as the first embodiment or the second embodiment.

Figure 8:
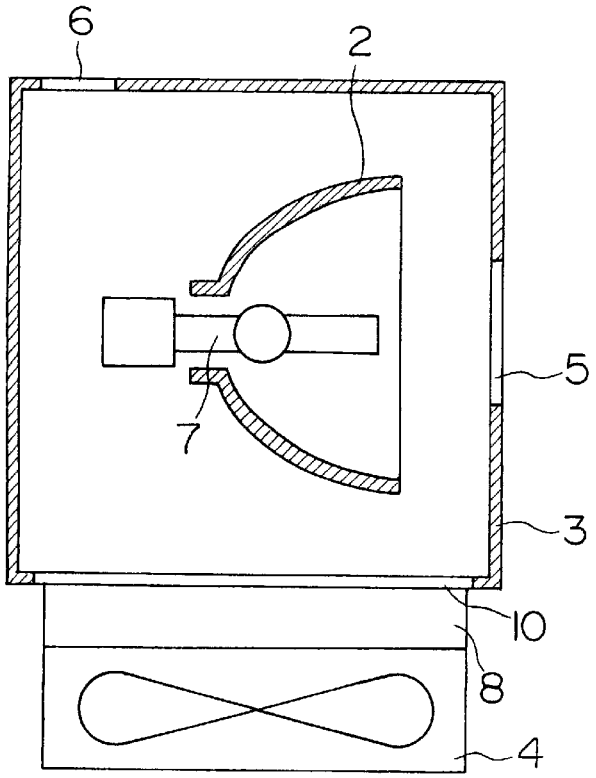
FIG. 8 is a transverse sectional view of the fourth embodiment.
Figure 9:
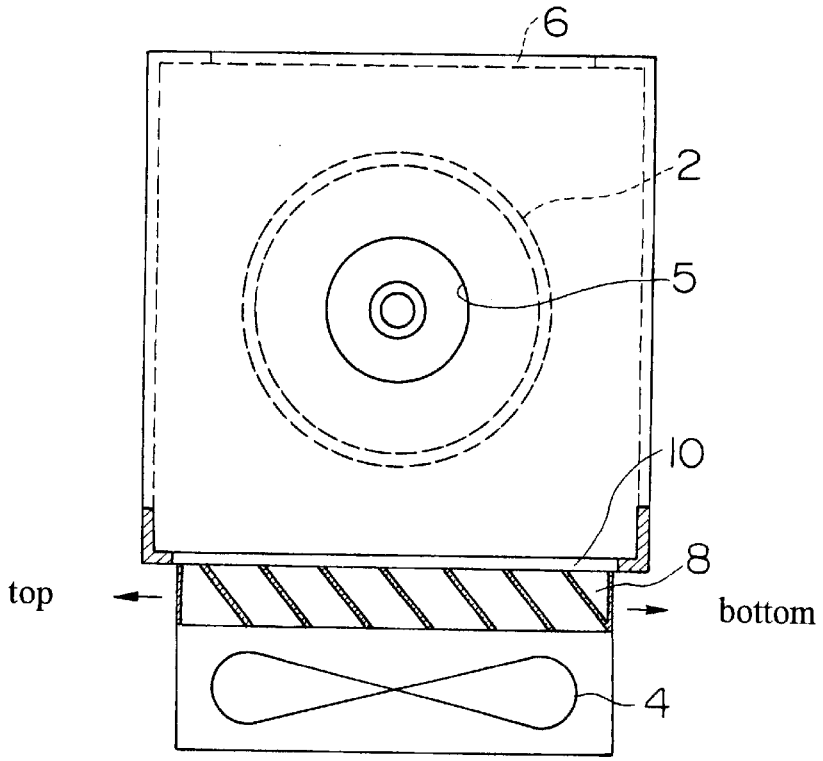
FIG. 9 is a side view of the fourth embodiment.

FIG. 8 is a transverse sectional view of the fourth embodiment, and FIG. 9 is a side view of the fourth embodiment.

In the fourth embodiment, a louver 8 for shading leakage light from the lamp 7 is disposed between the fan 4 and the window 10 of the case 3.

Figure 10:
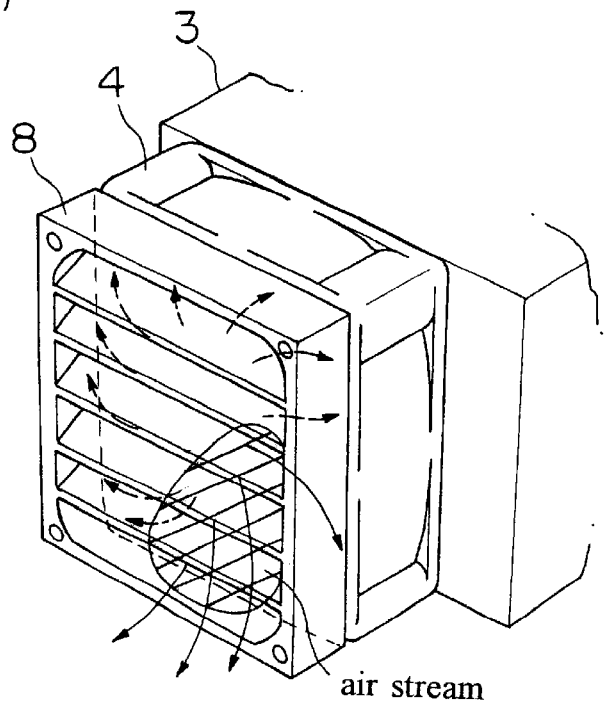
FIG.10 (Prior Art)
FIG. 10 is an arrangement drawing of the conventional louver.
Figure 11:
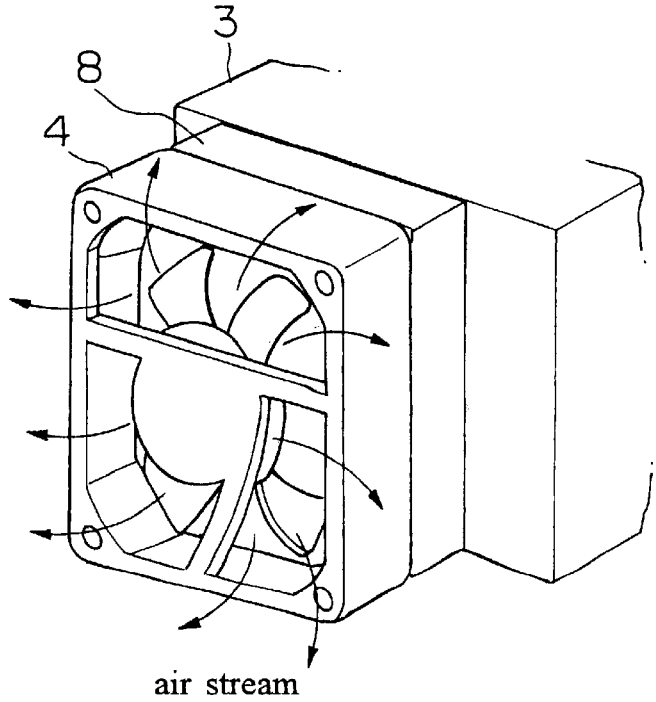
FIG. 11 is a sketch perspective view of the fourth embodiment.
Figure 12:
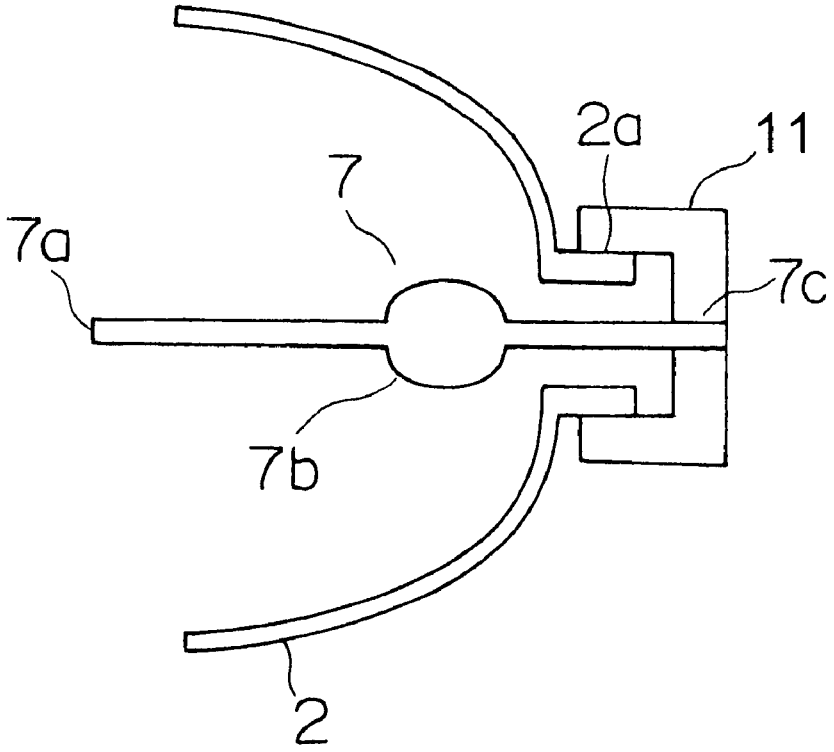
FIG.12 (Prior Art)
FIG. 12 is a cross-sectional view of the lamp and so on showing portions where the prescribed temperatures are set.

Referring now to FIG. 10 and FIG. 11, the effect of the fourth embodiment will be described.

FIG. 10 is an explanatory drawing showing the conventional arrangement where the louver 8 is disposed outside of the fan 4.

In the conventional arrangement, when the fan 4 is rotated clockwise, the air stream exhausted from the fan 4 flows as shown with short-dashed lines.

When the louver 8 is disposed in such a manner that the blades of the louver 8 are tilted with the outer edges down, exhausting action will be successively performed in the lower right portion in a front view (as shown with solid arrows in FIG. 10). However, in the upper left portion of the louver 8 in a front view, the air stream from the fan 4 is interrupted by the blades of the louver 8 (as shown with short-dashed arrows in FIG. 10) and thus exhausting action is not sufficiently performed. Therefore, it may cause problems such that the temperature within the case 3 may be uneven or the lifetime of the fan 4 may be shortened.

While in the fourth embodiment shown in FIG. 8, FIG. 9 and FIG. 11, the air exhausted from the fan 4 is not interrupted by the louver 8 and discharged evenly to a circumference(as shown with solid lines in FIG. 11), and thus exhaust efficiency of the fan 4 will be satisfactory to cool the interior of the case 3 sufficiently.

In order to prevent howling noises from emanating from the fan 4, it is desirable to provide a spacer, which is not shown in FIG. 8, FIG. 9 and FIG. 11, between the fan 4 and the louver 8 and to keep the fan 4 and the louver spaced apart 8 by at least 5 mm.

As described above, according to the present invention, components such as a lamp, a reflecting mirror, a lamp supporting portion, a fan and so on may be miniaturized, and even the specification and the performance of the lamp may be demonstrated sufficiently, and thereby elongation of the lifetime, uniformity of intensity, and satisfactory color rendering properties of the lamp may be ensured.

Further, by miniaturizing the whole lamp cartridge, the whole image displaying apparatus can be miniaturized.

In addition, exhaust efficiency of the fan may be improved to cool the interior of the case effectively without increasing the output of the fan. At the same time, elongation of the lifetime of the fan itself may be realized.

Industrial Applicability

A lamp cartridge associated with the present invention may be used as a lighting means for image display apparatus for High Definition Television (HDTV) Systems of the projecting type, as an image display apparatus for video projectors, and as an image display apparatus for various kinds of presentations.

What is claimed is:

1. A lamp cartridge, comprising:

a lamp utilized as a light source;

a reflecting mirror for converging light emitted by the lamp;

a case for covering the lamp and the reflecting mirror and for supporting the lamp and the reflecting mirror; and a fan, for exhausting heat from within the case, disposed at a window positioned on a side surface of the case covering a side of the reflecting mirror, said side surface being parallel to an optical axis of the reflecting mirror, wherein one of at least one surface forming the case from which a ray emitted from the reflecting mirror goes out includes an optical axis of the reflecting mirror and has a hole having a diameter smaller than the reflecting mirror formed thereon, and wherein outside air is introduced into the case through the hole and heat generated by the lamp and the reflecting mirror is exhausted by the fan.

2. The lamp cartridge according to claim 1, wherein a slit is provided on the surface of the case on the opposite side of the fan or the slit is provided on the surface of the case behind the reflecting mirror in the vicinity of the surface on the opposite side of the fan, and the outside air is introduced into the case through the slit and heat generated by the lamp and the reflecting mirror is exhausted by the fan.

3. The lamp cartridge according to claim 2, wherein the hole is disposed eccentrically relative to the optical axis of the reflecting mirror.

4. The lamp cartridge according to claim 3, wherein a louver for shading leakage light from the lamp is disposed between the case and the fan.

5. The lamp cartridge according to claim 1, wherein the hole is disposed eccentrically relative to the optical axis of the reflecting mirror.

6. The lamp cartridge according to claim 1, wherein the hole is disposed eccentrically relative to the optical axis of the reflecting mirror, and a louver for shading leakage light from the lamp is disposed between the case and the fan.

7. The lamp cartridge according to claim 2, wherein a louver for shading leakage light from the lamp is disposed between the case and the fan.

8. The lamp cartridge according to claim 1, wherein a louver for shading leakage light from the lamp is disposed between the case and the fan.

9. The lamp cartridge according to claim 1, wherein the center of the hole corresponds to the optical axis of the reflecting mirror.

10. The lamp cartridge according to claim 1, further comprising a clearance provided between the light source and the reflecting mirror at a neck portion of the reflecting mirror, wherein outside air introduced into the case through the hole passes through the clearance before being exhausted by the fan.

11. A lamp cartridge, comprising:

a lamp utilized as a light source;

a reflecting mirror for converging light emitted by the lamp;

a case for covering the lamp and the reflecting mirror and for supporting the lamp and the reflecting mirror; and a fan, for exhausting heat from within the case, disposed at a window positioned on a surface of the case behind the reflecting mirror, wherein one of at least one surface forming the case from which a ray emitted from the reflecting mirror goes out includes an optical axis of the reflecting mirror and has a hole formed thereon through which the optical axis extends, said hole having a diameter smaller than the reflecting mirror, and wherein outside air is introduced into the case through the hole and heat generated by the lamp and the reflecting mirror is exhausted by the fan.

12. The lamp cartridge according to claim 2, wherein at least one slit is provided on the side surface or at least one surface of the case covering at least one side of the reflecting mirror in the vicinity of the surface of the case which is on the opposite side of the fan, and the outside air is introduced into the case through the at least one slit and heat generated by the lamp and the reflecting mirror is exhausted by the fan.

13. The lamp cartridge according to claim 12, wherein the hole is disposed eccentrically relative to the optical axis of the reflecting mirror.

14. The lamp cartridge according to claim 13, wherein a louver for shading leakage light from the lamp is disposed between the case and the fan.

15. The lamp cartridge according to claim 12, wherein a louver for shading leakage light from the lamp is disposed between the case and the fan.

16. The lamp cartridge according to claim 11, further comprising a clearance provided between the light source and the reflecting mirror at a neck portion of the reflecting mirror, wherein outside air introduced into the case through the hole passes through the clearance before being exhausted by the fan.

17. A lamp cartridge, comprising:

a reflecting mirror outwardly reflecting light emitted by a light source disposed within said lamp cartridge;

a lamp cartridge casing formed by at least one side surface joined together so as to encompass the reflecting mirror and the light source;

a fan coupled to the lamp cartridge casing and an opening, in a side surface, that is obverse to the reflecting mirror, wherein a diameter of the opening is less than a diameter of an end of the reflecting mirror obverse to the opening, and an optical axis of the end of the reflecting mirror obverse to the opening extends through the opening, and wherein air flow generated by the fan flows into the lamp cartridge casing through the opening and out of the lamp cartridge casing through a window at a coupling point of the fan and the lamp cartridge casing.

18. The lamp cartridge according to claim 17, wherein the coupling point of the fan and the lamp cartridge casing is on a surface side that is perpendicular to the reflecting mirror with respect to the optical axis of the end of the reflecting mirror.

19. The lamp cartridge according to claim 17, wherein the coupling point of the fan and the lamp cartridge casing is on a surface side opposite to a direction in which the reflecting mirror outwardly reflects light.

20. The lamp cartridge of claim 17, wherein the opening is disposed accentrically relative to the optical axis of the reflecting mirror.

21. The lamp cartridge of claim 17, wherein the center of the opening corresponds to the optical axis of the reflecting mirror.

22. The lamp cartridge of claim 17, further comprising a clearance provided between the light source and the reflecting mirror at a neck portion of the reflecting mirror, wherein the air flow generated by the fan flows through the clearance before flowing through the window.

23. A method of manufacturing a lamp cartridge, comprising the steps of:

forming a lamp cartridge casing by joining together at least one side surface so as to encompass a reflecting mirror and a light source;

coupling a fan to the lamp cartridge casing at a coupling point; and creating an opening, in a side surface, that is obverse to the reflecting mirror, wherein a diameter of the opening is less than a diameter of an end of the reflecting mirror obverse to the opening, and an optical axis of the end of the reflecting mirror obverse to the opening extends through the opening, and wherein air flow generated by the fan flows into the lamp cartridge casing through the opening and out of the lamp cartridge casing through a window at a coupling point of the fan and the lamp cartridge casing.

24. The method of manufacturing a lamp cartridge according to claim 23, wherein the coupling point of the fan and the lamp cartridge casing is on a surface side that is perpendicular to the reflecting mirror with respect to the optical axis of the end of the reflecting mirror.

25. The method of manufacturing a lamp cartridge according to claim 23, wherein the coupling point of the fan and the lamp cartridge casing is on a surface side opposite to a direction in which the reflecting mirror outwardly reflects light.

26. The method of manufacturing a lamp cartridge according to claim 23, wherein the opening is disposed eccentrically relative to the optical axis of the reflecting mirror.

27. The method of manufacturing a lamp cartridge according to claim 23, wherein the center of the opening corresponds to the optical axis of the reflecting mirror.

28. The method of claim 23, further comprising:

forming a clearance between the light source and the reflecting mirror at a neck portion of the reflecting mirror; and passing the air flow through the clearance before the air flow exits the lamp cartridge casing.

* * * * *